US007381164B2

(12) United States Patent
Smith et al.

(10) Patent No.: US 7,381,164 B2
(45) **Date of Patent: *Jun. 3, 2008**

(54) ROWING DEVICE WITH A LIFTING DEVICE

(75) Inventors: Jeffrey A. Smith, Ft. Lauderdale, FL (US); Leao Wang, Taiping (TW)

(73) Assignee: Fitcrew Corp., Taiping (TW)

( * ) Notice: Subject to any disclaimer, the term of this patent is extended or adjusted under 35 U.S.C. 154(b) by 631 days.

This patent is subject to a terminal disclaimer.

(21) Appl. No.: 10/887,422

(22) Filed: Jul. 9, 2004

(65) Prior Publication Data

US 2006/0009334 A1 Jan. 12, 2006

(51) Int. Cl.
*A63B 69/06* (2006.01)

(52) U.S. Cl. ..... 482/72; 482/73; 482/908

(58) Field of Classification Search ..... 482/51–53, 482/62, 110, 135, 144, 57, 121, 70–73, 908
See application file for complete search history.

(56) References Cited

U.S. PATENT DOCUMENTS 1,205,426 A * 11/1916 Barnhill ..... 482/72
4,421,307 A * 12/1983 Cunnington et al. ..... 482/72
4,795,147 A * 1/1989 Seal ..... 482/73
5,072,929 A * 12/1991 Peterson et al. ..... 482/72
5,658,225 A * 8/1997 Huang ..... 482/72
5,752,879 A * 5/1998 Berdut ..... 482/96
5,916,069 A * 6/1999 Wang et al. ..... 482/72
6,682,462 B1 * 1/2004 Lee ..... 482/72
6,761,670 B2 * 7/2004 Liou ..... 482/72
6,981,932 B1 * 1/2006 Huang et al. ..... 482/72
6,991,589 B1 * 1/2006 Patterson ..... 482/72
7,108,639 B2 * 9/2006 Smith et al. ..... 482/72
2005/0272568 A1 * 12/2005 Wang et al. ..... 482/72

* cited by examiner

*Primary Examiner*—Steve R Crow

(57) ABSTRACT

A rowing machine having a supporting frame with a seat movable thereon. The supporting frame is pivotally attached to an upright support of a base frame. A lifting device is pivotably interposed between the supporting frame and the base frame for adjusting the angle of the supporting frame relative to the base frame.

1 Claim, 2 Drawing Sheets

ROWING DEVICE WITH A LIFTING DEVICE

BACKGROUND OF THE INVENTION

1. Fields of the Invention

The invention relates to a rowing machine, and more particularly, to a rowing machine having a lifting device for adjusting the angle of a supporting frame relative to a base frame.

2. Description of the Related Art

A rowing machine is a fitness device having a mechanism with two oarlike handles (or a movable bar), foot braces, and a sliding seat, allowing the user to go through the reciprocating motions of rowing in a racing shell.

U.S. Pat. No. 5,916,069 teaches a rowing exerciser with magnetic resistance having a supporting frame on which a seat moves for supporting the operator's body. This configuration allows the operator to stably sit on the seat during exercise. However, individual adjustment to weight is not possible, height and physical condition of each operator. The reciprocating motion of the rowing machine at a single angle can't meet different requirements of operators any more.

SUMMARY OF THE INVENTION

It is a primary object of the invention is to provide a rowing machine with a function to adjust the sitting angle of the operator during the exercise session.

It is another object of the invention is to provide a rowing machine with a supporting frame to adjust the angle of the supporting frame for locating the operator's body in an inclined position.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
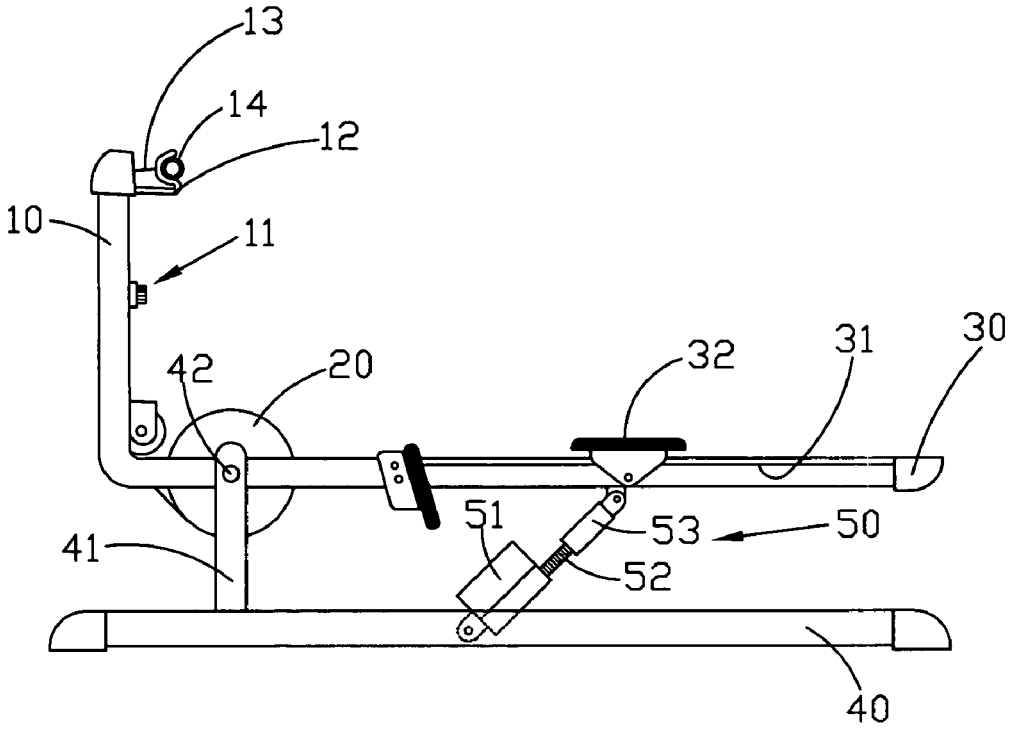
FIG. 1 is a side view of a first embodiment of the invention.

Referring to FIG. 1, a rowing machine in accordance with the invention includes a main frame 10 with a control knob 11. A stop rod 12 is provided at the top of the main frame 10 for limiting the motion of a handgrip 14 in connection with a pull rope 13. A supporting frame 30 having a flywheel rewinder 20 mounted on one side thereof is integrally joined to the main frame 10. The pull rope 13 passes through a pulley (not shown) within the main frame 10 and is wounded around the flywheel rewinder 20. When the pull rope 13 is pulled by the handgrip 14 and extended over a certain length, the flywheel accumulates its resilience. Thereafter, the pull rope 13 will be rewound around the flywheel rewinder 20 again by the resilience accumulated by the flywheel rewinder 20 when the handgrip 14 is released to return to the stop rod 12.

Moreover, the supporting frame 30 includes rails 31 for a seat 32 to perform a reciprocating movement thereon. The supporting frame 30 together with the flywheel rewinder 20 is rotatable on a pivot 42 in an upright support 41 of the base frame 40. Moreover, a lifting device 50 is interposed between the supporting frame 30 and the base frame 40 for controlling the supporting frame 30 at a certain angle relative to the base frame 40. The lifting device 50 can includes an electric motor 51 that drives a socket 53 screwed on a spindle 52 to undergo a reciprocating motion in axial direction.

Figure 2:
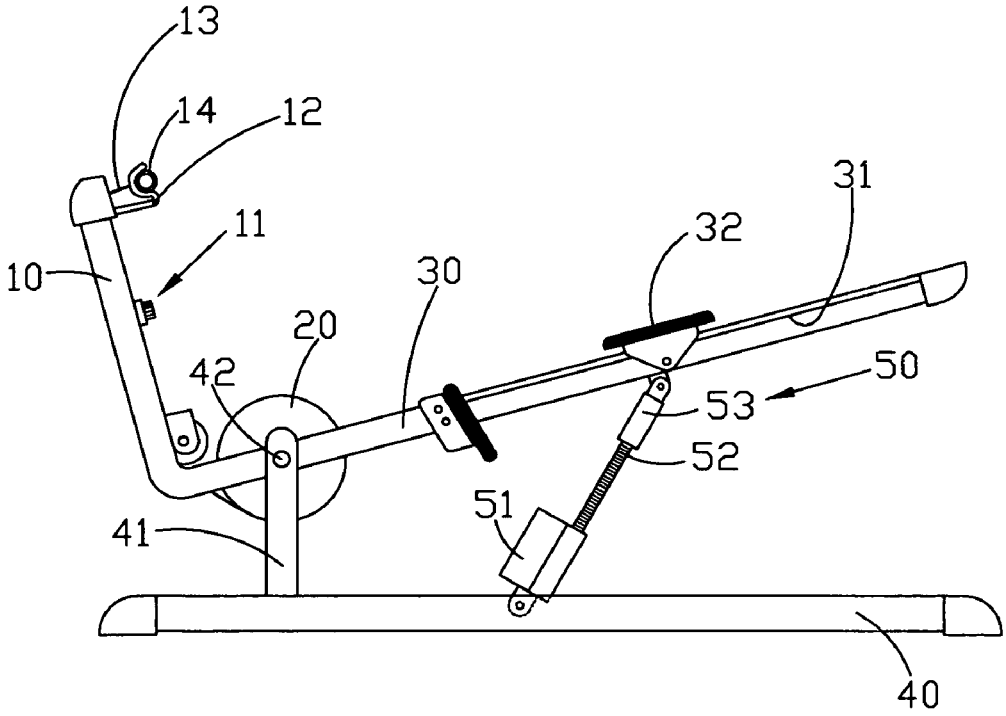
FIG. 2 is a side view of the first embodiment of the invention with a lifting device in an extended position.

As shown in FIG. 2, the lifting device 50 is electrically controlled and can be extended to lift the supporting frame 30 together with the main frame 10 on the pivot 42 in such an inclined position that the operator sitting on the seat 32 can overlook the ground. Alternatively, the supporting frame 30 can be pulled back by the lifting device 50 in such an inclined position that the operator sitting on the seat 32 can look up to the sky.

Figure 3:
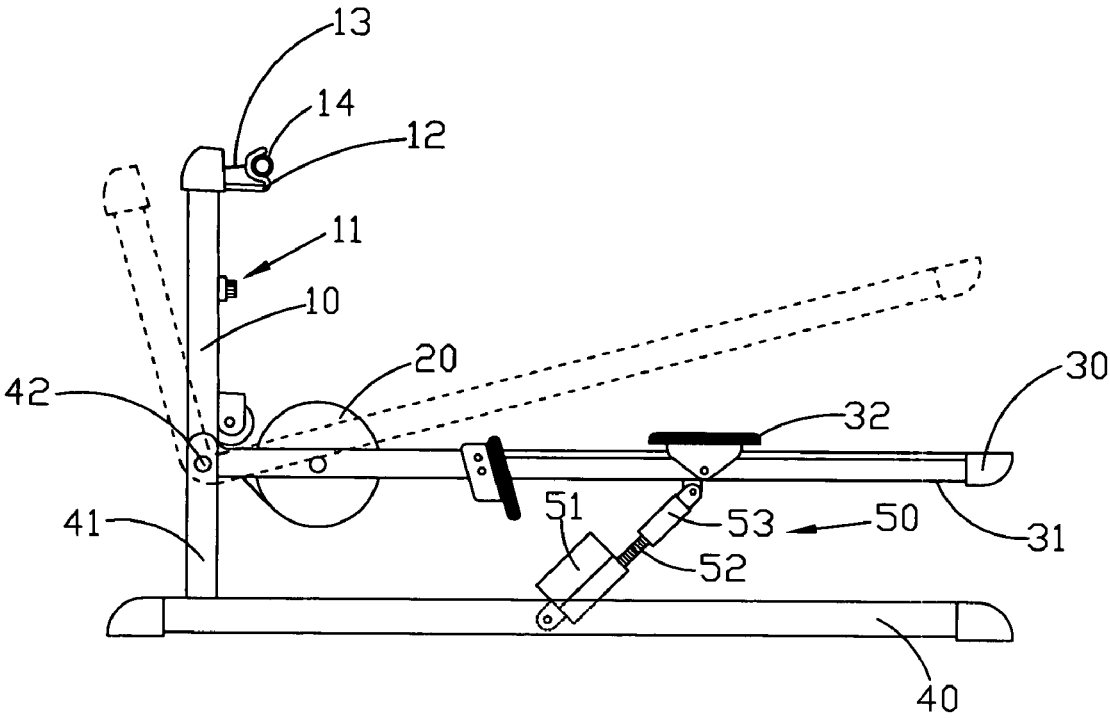
FIG. 3 is a side view of a second embodiment of the invention wherein a supporting frame moved in an inclined position is marked with dashed line.

FIG. 3 shows a second embodiment of the invention. The rowing machine in accordance with this embodiment includes a main frame 10 with a control knob 11. A stop rod 12 is provided at the top of the main frame 10 for limiting the motion of a handgrip 14 in connection with a pull rope 13. A supporting frame 30 having a flywheel rewinder 20 mounted on one side thereof is integrally joined to the main frame 10. The pull rope 13 is connected to the flywheel rewinder 20. A seat 32 mounted on the supporting frame 30 is movable in the rails 31. In addition, the supporting frame 30 is rotatable on a pivot 42 in the upright support 41 aligned with the main frame 10. Moreover, a lifting device 50 is interposed between the supporting frame 30 and the base frame 40 for controlling the supporting frame 30 at a certain angle relative to the base frame 40. The lifting device 50 can include an electric motor 51 that drives a socket 53 screwed on a spindle 52 to undergo a reciprocating motion in axial direction.

Based on the aforementioned configuration, the supporting frame 30 can be brought by the lifting device 50 in such an inclined position marked by dashed line in FIG. 3. Meanwhile, the supporting frame 30 can be lowered in another inclined position by retracting the lifting device 50.

Figure 4:
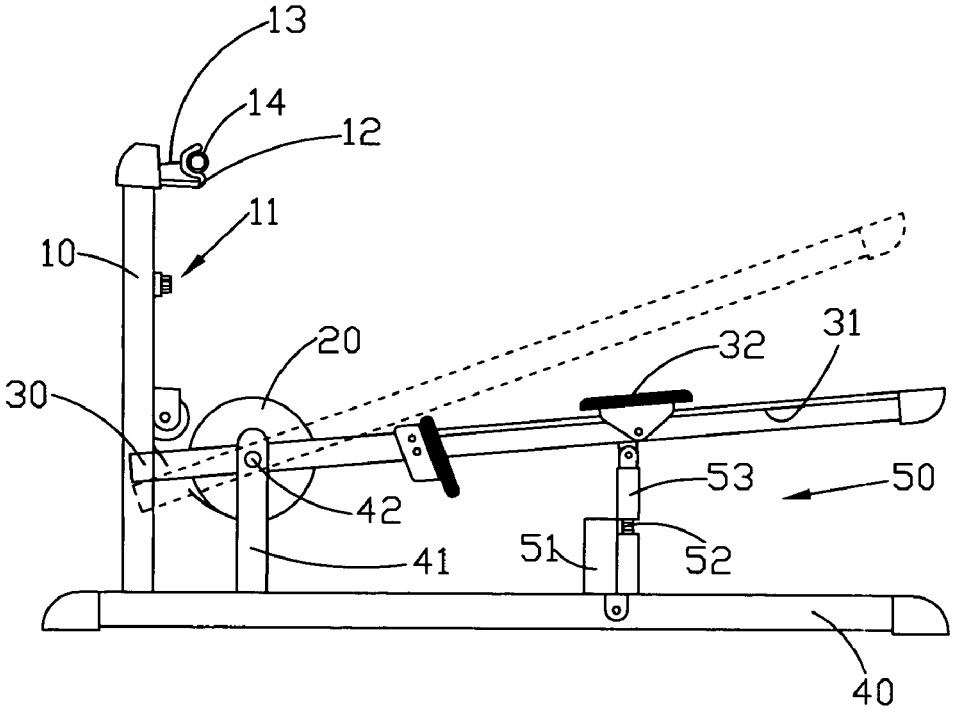
FIG. 4 is a side view of a third embodiment of the invention wherein the supporting frame moved in an inclined position is marked with dashed line.

FIG. 4 shows a third embodiment of the invention. The rowing machine in accordance with this embodiment includes a main frame 10 with a control knob 11. A stop rod 12 is provided at the top of the main frame 10 for limiting the motion of a handgrip 14 in connection with a pull rope 13. The bottom of the main frame 10 is secured to the base frame 40.

Moreover, the supporting frame 30 is fitted with rails 31 for installing a seat 32 to move to and fro therein. A flywheel rewinder 20 having a pull rope 13 winding therearound is attached to one side of the supporting frame 30. The supporting frame 30 together with the flywheel rewinder 20 is rotatable on a pivot 42 in an upright support 41 of the base frame 40. Moreover, a lifting device 50 is interposed between the supporting frame 30 and the base frame 40 for controlling the supporting frame 30 at a certain angle relative to the base frame 40. The lifting device 50 can includes an electric motor 51 that drives a socket 53 screwed on a spindle 52 to undergo a reciprocating motion in axial direction.

Based on the aforementioned configuration, the supporting frame 30 supported by the upright support 41 and the lifting device 50 can be brought by the lifting device 50 in such an inclined position marked by dashed line in FIG. 3. Meanwhile, the supporting frame 30 can be lowered in another inclined position by retracting the lifting device 50. The difference of the third embodiment from the above two embodiments is that the main frame 10 and the base frame 40 are rigidly connected to each other and they won't be moved with the supporting frame 30.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A rowing machine comprising:

a main frame having an elongated base frame;

an upright support 41 near a forward end of the base frame;

a support frame having a flywheel and rewinder mechanism attached thereto and a seat 32 slidable during exercise along the support frame;

said support frame pivotally attached to the upright support;

a handgrip connected to the flywheel via a pull rope;

a motorized angle adjusting mechanism having a telescoping tube and having one end pivotally connected to the base frame at a central location on the base frame, and a second end pivotally connected to the support frame at a central location on the support frame;

wherein the upright and the adjustment mechanism are the sole supports for the support frame on the base frame.

* * * * *